US011450265B2

(12) United States Patent
Yoo et al.

(10) Patent No.: US 11,450,265 B2
(45) Date of Patent: Sep. 20, 2022

(54) DISPLAY DEVICE AND DRIVING METHOD OF THE SAME

(71) Applicant: LG Display Co., Ltd., Seoul (KR)

(72) Inventors: Minjae Yoo, Seoul (KR); JaeYoon Kim, Seoul (KR); GyuJin Bae, Gyeonggi-do (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 17/513,407

(22) Filed: Oct. 28, 2021

(65) Prior Publication Data

US 2022/0139311 A1 May 5, 2022

(30) Foreign Application Priority Data

Nov. 4, 2020 (KR) ..... 10-2020-0145681

(51) Int. Cl.
*G09G 3/3208* (2016.01)
*G09G 3/00* (2006.01)

(52) U.S. Cl.
CPC ..... *G09G 3/3208* (2013.01); *G09G 3/035* (2020.08); *G09G 2300/0842* (2013.01); *G09G 2320/0257* (2013.01)

(58) Field of Classification Search
CPC ..... G09G 3/3208; G09G 3/035; G09G 2300/0842; G09G 2320/0257
See application file for complete search history.

(56) References Cited

U.S. PATENT DOCUMENTS

2014/0146066 A1* 5/2014 Kang ..... G09G 3/3225 345/545
2018/0061327 A1* 3/2018 Hong ..... G09G 3/3275
2018/0240399 A1* 8/2018 Lin ..... G09G 3/32

FOREIGN PATENT DOCUMENTS

CN 103377629 B * 3/2016 ..... G09G 3/2077
KR 20140075061 A * 6/2014
KR 20200025938 A * 3/2020

* cited by examiner

*Primary Examiner* — Ricardo Osorio
(74) *Attorney, Agent, or Firm* — Seed IP Law Group LLP

(57) ABSTRACT

A display device includes a display panel and a display driving circuit having improved degradation uniformity. The display panel includes sub-pixels, each of which includes a light emitting element and a driving transistor. The display driving circuit drives the display panel to display a degradation uniformity restoration image in an afterimage occurrence predicted area detected in the display panel during an image quality control period. The afterimage occurrence predicted area includes first and second sub-pixels of the sub-pixels. Before the image quality control period, the amount of accumulated current having flowed through the first sub-pixel is greater than the amount of accumulated current having flowed through the second sub-pixel. During the image quality control period, the amount of current flowing through the second sub-pixel is greater than the amount of current flowing through the first sub-pixel.

18 Claims, 14 Drawing Sheets

DISPLAY DEVICE AND DRIVING METHOD OF THE SAME

CROSS-REFERENCE TO RELATED APPLICATION

This application claims the priority benefit Republic of Korea Patent Application No. 10-2020-0145681, filed on Nov. 4, 2020 in the Korean Intellectual Property Office, the disclosure of which is incorporated herein by reference in its entirety.

BACKGROUND

Technical Field

The present disclosure relates to display devices and methods of driving the display device.

Description of the Related Art

Among display devices having been developed recently, display devices in which sub-pixels disposed in a display panel include light emitting elements have become more attractive. Each sub-pixel disposed on the display panel of such a display device includes a light emitting element, where the light emitting element itself emits light, and a driving transistor for driving the light emitting element.

Circuit elements, such as driving transistors, light emitting elements, and the like, disposed in the display panel each have their own characteristic values. For example, each driving transistor has its own characteristic value, such as a threshold voltage, mobility, and the like, and each light emitting element has its own characteristic value, such as a threshold voltage, and the like.

The characteristic values of the circuit elements in each sub-pixel may vary due to degradation as the driving time over the life of the sub-pixel accumulates.

BRIEF SUMMARY

The inventors have realized that differences exist in driving time for each sub-pixel, which may cause circuit elements in the sub-pixels to age or degrade differently. Due to such a difference in degradation between sub-pixels, display devices may suffer deteriorated image quality. Embodiments of the present disclosure provide display devices capable of improving the uniformity of degradation of a display panel, and methods of driving the display device.

Embodiments of the present disclosure provide display devices capable of performing degradation uniformity restoration driving, for example, in an area where an afterimage is predicted to occur, and normal driving in other areas. A method of driving the display device is also provided in various embodiments.

Embodiments of the present disclosure provide display devices capable of performing degradation uniformity restoration driving in a time period that does not affect viewing by a user, and methods of driving the display device.

According to embodiments of the present disclosure, a display device is provided that includes a display panel including a plurality of sub-pixels each including a light emitting element such as an organic light emitting diode, etc., and a driving transistor, and a display driving circuit capable of driving the display panel so that a degradation uniformity restoration image can be displayed in an afterimage occurrence predicted area detected in the display panel during an image quality control period.

Sub-pixels included in the afterimage occurrence predicted area may include a first sub-pixel and a second sub-pixel. Before the image quality control period, the amount of accumulated current having flowed through the first sub-pixel may be greater than the amount of accumulated current having flowed through the second sub-pixel. However, during the image quality control period, the amount of current flowing through the second sub-pixel may be greater than the amount of current flowing through the first sub-pixel.

The degradation uniformity restoration image may include a first portion in which a darkest image is present and a second portion outside of the first portion. In the degradation uniformity restoration image, the second portion may become brighter as it moves toward the first portion, and may become darker as it moves away from the first portion.

The afterimage occurrence predicted area may be an area in which one or more object images of a logo, a subtitle, content information, and broadcast information were displayed during a normal display period before the image quality control period.

The first sub-pixel and the second sub-pixel included in the afterimage occurrence predicted area may have different degradation states, and the first sub-pixel may be in a more degraded state than the second sub-pixel.

During the image quality control period, the display driving circuit can supply a degradation acceleration data voltage that causes the second sub-pixel to emit light more brightly than the first sub-pixel to the second sub-pixel, and supply a degradation deceleration data voltage that causes the first sub-pixel to emit light more darkly than the second sub-pixel to the first sub-pixel, or drive the first sub-pixel not to emit light.

The plurality of sub-pixels may further include a third sub-pixel included in the afterimage occurrence predicted area.

When a distance between the third sub-pixel and the first sub-pixel is greater than a distance between the second sub-pixel and the first sub-pixel, during the image quality control period, the display driving circuit can supply a degradation acceleration data voltage that causes the third sub-pixel to emit light more darkly than the second sub-pixel to the third sub-pixel.

During the image quality control period, the display driving circuit can cause light emitting elements of sub-pixels included in an afterimage occurrence non-predicted area other than an afterimage occurrence predicted area in the display panel not to emit light.

The display device according to aspects of the present disclosure may further include an area detection circuit capable of determining a degradation state of each of a plurality of sub-pixels based on accumulated current data in each of the plurality of sub-pixels, and detecting one or more areas having a degradation difference greater than or equal to a threshold level as an afterimage occurrence predicted area.

The display device according to aspects of the present disclosure may further include a control timing determining circuit capable of determining a period during which the display surface of the display panel is not exposed to users as an image quality control period.

The display device according to aspects of the present disclosure may be, for example, a foldable display device. In this embodiment, the image quality control period may be a period during which the display surface of the display panel is not exposed as the display device is folded.

The display device according to aspects of the present disclosure may be, for example, a rollable display device. In this embodiment, the image quality control period may be a period during which the display surface of the display panel is not exposed as the display device is rolled.

According to aspects of the present disclosure, a method of driving a display device including a display panel including a plurality of sub-pixels each including a light emitting element such as an organic light emitting diode, etc., and a driving transistor, and a display driving circuit capable of driving the display panel.

The method of driving the display device can include determining an image quality control period, and driving the display panel so that a degradation uniformity restoration image can be displayed in an afterimage occurrence predicted area detected in the display panel during the image quality control period.

According to the method of driving the display device, sub-pixels included in the afterimage occurrence predicted area may include a first sub-pixel and a second sub-pixel.

According to the method of driving the display device, before the image quality control period, the amount of accumulated current having flowed through the first sub-pixel may be greater than the amount of accumulated current having flowed through the second sub-pixel. However, during the image quality control period, the amount of current flowing through the second sub-pixel may be greater than the amount of current flowing through the first sub-pixel.

According to the method of driving the display device, the degradation uniformity restoration image may include a first portion in which a darkest image is present, and a second portion outside of the first portion. In this situation, the second portion may become brighter as it moves toward the first portion, and may become darker as it moves away from the first portion.

According to the method of driving the display device, the afterimage occurrence predicted area may be an area in which one or more object images of a logo, a subtitle, content information, and broadcast information were displayed during a normal display period before the image quality control period.

The first sub-pixel and the second sub-pixel included in the afterimage occurrence predicted area may have different degradation states, and the first sub-pixel may be in a more degraded state than the second sub-pixel.

According to the method of driving the display device, when the driving of the display panel is performed, during the image quality control period, the display panel can be driven so that a degradation acceleration data voltage that causes the second sub-pixel to emit light more brightly than the first sub-pixel can be supplied to the second sub-pixel, and a degradation deceleration data voltage that causes the first sub-pixel to emit light more darkly than the second sub-pixel can be supplied to the first sub-pixel, or the first sub-pixel can be driven not to emit light.

The method of driving the display device according to aspects of the present disclosure may further include determining a degradation state of each of a plurality of sub-pixels based on accumulated current data in each of the plurality of sub-pixels, and detecting one or more areas having a degradation difference greater than or equal to a threshold level as an afterimage occurrence predicted area.

When the determining of the image quality control period is performed, the display device can determine a period during which the display surface of the display panel is not exposed to users as an image quality control period.

The display device according to aspects of the present disclosure may be, for example, a foldable display device. In this embodiment, the image quality control period may be a period during which the display surface of the display panel is not exposed as the display device is folded.

The display device according to aspects of the present disclosure may be, for example, a rollable display device. In this embodiment, the image quality control period may be a period during which the display surface of the display panel is not exposed as the display device is rolled.

According to aspects of the present disclosure, a display device is provided that includes a display panel including a plurality of data lines and a plurality of gate lines and including a plurality of sub-pixels each including a light emitting element such as an organic light emitting diode, etc., and a driving transistor, and a display driving circuit capable of driving the display panel.

The plurality of sub-pixels may include a first sub-pixel and a second sub-pixel having different degradation states, and the first sub-pixel may be in a more degraded state than the second sub-pixel.

During an image quality control period, the display driving circuit can supply a degradation acceleration data voltage that causes the second sub-pixel to emit light more brightly than the first sub-pixel to the second sub-pixel, and supply a degradation deceleration data voltage that causes the first sub-pixel to emit light more darkly than the second sub-pixel to the first sub-pixel, or drive the first sub-pixel not to emit light.

The first sub-pixel can emit light with a first luminance value in response to a first data voltage, and the second sub-pixel can emit light with a second luminance value different from the first luminance value in response to the first data voltage, and a difference between a reference luminance value and the first luminance value may be greater than a difference between the reference luminance value and the second luminance value.

According to embodiments of the present disclosure, it is possible to provide display devices capable of improving the uniformity of degradation of a display panel, and methods of driving the display device. Thereby, image quality can be improved.

According to embodiments of the present disclosure, it is possible to provide display devices capable of performing degradation uniformity restoration driving in an area where an afterimage is predicted to occur, and method of driving the display device. Thereby, it is possible to reduce or minimize shortening a lifetime of the display panel through the degradation uniformity restoration driving, and reduce power consumption.

According to embodiments of the present disclosure, it is possible to provide display devices capable of performing degradation uniformity restoration driving in a time period that does not affect user's viewing, and methods of driving the display device.

BRIEF DESCRIPTION OF THE SEVERAL VIEWS OF THE DRAWINGS

The accompanying drawings, which are included to provide a further understanding of the disclosure and are incorporated in and constitute a part of the disclosure, illustrate aspects of the disclosure and together with the description serve to explain the principle of the disclosure. In the drawings.

DETAILED DESCRIPTION

Figure 1:
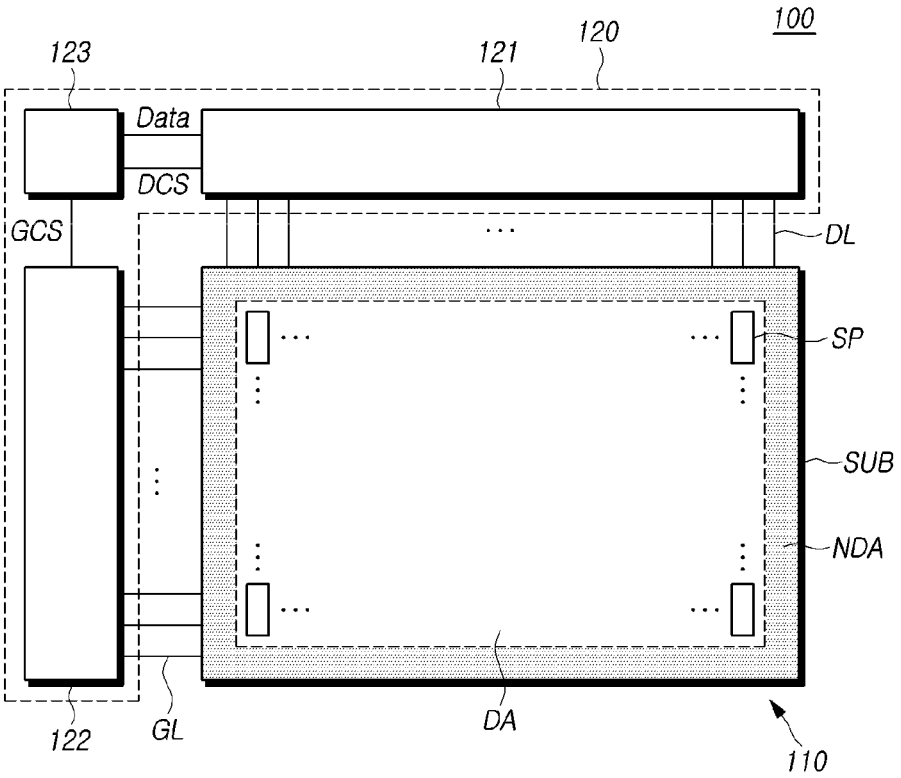
FIG. 1 illustrates a system configuration of a display device according to aspects of the present disclosure.

In the following description of examples or embodiments of the present disclosure, reference will be made to the accompanying drawings in which it is shown by way of illustration specific examples or embodiments that can be implemented, and in which the same reference numerals and signs can be used to designate the same or like components even when they are shown in different accompanying drawings from one another. Further, in the following description of examples or embodiments of the present disclosure, detailed descriptions of well-known functions and components incorporated herein will be omitted when it is determined that the description may make the subject matter in some embodiments of the present disclosure rather unclear. The terms such as "including," "having," "containing," "constituting" "make up of," and "formed of" used herein are generally intended to allow other components to be added unless the terms are used with the term "only." As used herein, singular forms are intended to include plural forms unless the context clearly indicates otherwise.

Terms, such as "first," "second," "A," "B," "(A)," or "(B)" may be used herein to describe elements of the present disclosure. Each of these terms is not used to define essence, order, sequence, or number of elements, etc., but is used merely to distinguish the corresponding element from other elements.

When it is mentioned that a first element "is connected or coupled to," "contacts or overlaps," etc., a second element, it should be interpreted that, not only can the first element "be directly connected or coupled to" or "directly contact or overlap" the second element, but a third element can also be "interposed" between the first and second elements, or the first and second elements can "be connected or coupled to," "contact or overlap," etc., each other via a fourth element. Here, the second element may be included in at least one of two or more elements that "are connected or coupled to," "contact or overlap," etc., each other.

When time relative terms, such as "after," "subsequent to," "next," "before," and the like, are used to describe processes or operations of elements or configurations, or flows or steps in operating, processing, manufacturing methods, these terms may be used to describe non-consecutive or non-sequential processes or operations unless the term "directly" or "immediately" is used together.

In addition, when any dimensions, relative sizes, etc., are mentioned, it should be considered that numerical values for an elements or features, or corresponding information (e.g., level, range, etc.) include a tolerance or error range that may be caused by various factors (e.g., process factors, internal or external impact, noise, etc.) even when a relevant description is not specified. Further, the term "may" fully encompasses all the meanings of the term "can."

FIG. 1 illustrates a system configuration of a display device 100 according to aspects of the present disclosure.

Referring to FIG. 1, the display device 100 according to aspects of the present disclosure includes a display panel 110 and a display driving circuit 120 for driving the display panel 110.

The display driving circuit 120 may include a data driving circuit 121 and a gate driving circuit 122, and further include a controller 123 for controlling the data driving circuit 121 and the gate driving circuit 122.

The display panel 110 may include a substrate SUB, and signal lines disposed over the substrate SUB, such as a plurality of data lines DL, a plurality of gate lines GL, and the like. The display panel 110 may include a plurality of sub-pixels SP connected to the plurality of data lines DL and the plurality of gate lines GL.

The display panel 110 may include a display area DA in which an image is displayed, and a non-display area NDA, in which an image is not displayed, different from the display area DA. In the display panel 110, the plurality of sub-pixels SP for displaying images may be disposed in the display area DA, and the driving circuits (120, 121, 122) may be electrically connected to, or mounted in, the non-display area NDA. Further, a pad portion to which an integrated circuit or a printed circuit is connected may be disposed in the non-display area NDA.

The data driving circuit 121 is a circuit for driving the plurality of data lines DL, and can supply data signals to the plurality of data lines DL. The gate driving circuit 122 is a circuit for driving the plurality of gate lines GL, and can supply gate signals to the plurality of gate lines GL. The controller 123 can supply a data control signal DCS to the data driving circuit 121 in order to control an operation timing of the data driving circuit 121. The controller 123 can supply a gate control signal GCS to the gate driving circuit 122 in order to control an operation timing of the gate driving circuit 122.

The controller 123 starts a scanning operation according to timings scheduled in each frame, converts image data inputted from other devices or other image providing sources to a data signal type used in the data driving circuit 121 and then supplies image data DATA resulting from the converting to the data driving circuit 121, and controls the loading of the data to at least one pixel at a pre-configured time according to a scan timing.

The controller 123 can receive, in addition to input image data, several types of timing signals including a vertical synchronization signal VSYNC, a horizontal synchronization signal HSYNC, an input data enable signal DE, a clock signal, and the like from other devices, networks, or systems (e.g., a host system 150).

To control the data driving circuit 121 and the gate driving circuit 122, the controller 123 can receive one or more of the timing signals such as the vertical synchronization signal VSYNC, the horizontal synchronization signal HSYNC, the input data enable signal DE, the clock signal, and the like, generate several types of control signals (DCS, GCS), and supply the generated signals to the data driving circuit 121 and the gate driving circuit 122.

The controller 123 may be implemented in the form of a separate component from the data driving circuit 121, or integrated with the data driving circuit 121 and implemented into an integrated circuit.

The data driving circuit 121 can drive a plurality of data lines DL by receiving image data DATA from the controller 123 and supplying data voltages to the plurality of data lines DL. Here, the data driving circuit 121 may also be referred to as a source driving circuit.

The data driving circuit 121 may include one or more source driver integrated circuits SDIC. Each source driver integrated circuit SDIC may include a shift register, a latch circuit, a digital-to-analog converter DAC, an output buffer, and the like. In some instances, each source driver integrated circuit SDIC may further include an analog to digital converter ADC.

In some embodiments, each source driving circuit SDIC may be connected to the display panel 110 in a tape automated bonding (TAB) type, or connected to a conductive pad such as a bonding pad of the display panel 110 in a chip on glass (COG) type or a chip on panel (COP) type, or connected to the display panel 110 in a chip on film (COF) type.

The gate driving circuit 122 can output a gate signal of a turn-on level voltage or a gate signal of a turn-off level voltage according to the control of the controller 123. The gate driving circuit 122 can sequentially drive a plurality of gate lines GL by sequentially supplying the gate signal of the turn-on level voltage to the plurality of gate lines GL.

In some embodiments, the gate driving circuit 122 may be connected to the display panel 110 in the tape automated bonding (TAB) type, or connected to a conductive pad such as a bonding pad of the display panel 110 in the chip on glass (COG) type or the chip on panel (COP) type, or connected to the display panel 110 in the chip on film (COF) type. In another embodiment, the gate driving circuit 122 may be located in the non-display area NDA of the display panel 110 in a gate in panel (GIP) type. The gate driving circuit 122 may be disposed on or over a substrate SUB, or connected to the substrate SUB. That is, in the case of the GIP type, the gate driving circuit 122 may be disposed in the non-display area NDA of the substrate SUB. The gate driving circuit 122 may be connected to the substrate SUB in the case of the chip on glass (COG) type, the chip on film (COF) type, or the like.

When a specific gate line is asserted by the gate driving circuit 122, the data driving circuit 121 can convert image data DATA received from the controller 123 into data voltages in an analog form and supplies the data voltages resulting from the converting to a plurality of data lines DL.

The data driving circuit 121 may be located on, but not limited to, one portion (e.g., an upper portion or a lower portion) of the display panel 110. In some embodiments, the data driving circuit 121 may be located on, but not limited to, two portions (e.g., an upper portion and a lower portion) of the display panel 110 or at least two of four portions (e.g., an upper portion, a lower portion, a left portion, and a right portion) of the display panel 110 according to driving schemes, panel design schemes, or the like.

The gate driving circuit 122 may be located on, but not limited to, one portion (e.g., a left portion or a right portion) of the display panel 110. In some embodiments, the gate driving circuit 122 may be located on, but not limited to, two portions (e.g., a left portion and a right portion) of the display panel 110 or at least two of four portions (e.g., an upper portion, a lower portion, a left portion, and a right portion) of the display panel 110 according to driving schemes, panel design schemes, or the like.

The controller 123 may be a timing controller used in the typical display technology or a control apparatus/device capable of additionally performing other control functionalities in addition to the typical function of the timing controller. In some embodiments, the controller 140 may be one or more other control circuits different from the timing controller, or a circuit or component in the control apparatus/device The controller 123 may be implemented using various circuits or electronic components such as an integrated circuit (IC), a field programmable gate array (FPGA), an application specific integrated circuit (ASIC), a processor, and/or the like.

The controller 123 may be mounted on a printed circuit board, a flexible printed circuit, or the like, and may be electrically connected to the data driving circuit 121 and the gate driving circuit 122 through the printed circuit board, the flexible printed circuit, or the like.

The controller 123 may transmit signals to, and receive signals from, the data driving circuit 121 via one or more predetermined interfaces or selected interfaces. In some embodiments, such interfaces may include a low voltage differential signaling (LVDS) interface, an EPI interface, a serial peripheral interface (SPI), and the like. The controller 123 may include a storage medium such as one or more registers.

The display device 100 according to aspects of the present disclosure may be a display including a backlight unit such as a liquid crystal display device, or the like, or may be a self-emissive display such as an organic light emitting diode (OLED) display, a quantum dot (QD) display, a micro light emitting diode (M-LED) display, and the like. The backlight unit may be or include a backlight device, such as a light source including, for example, an array of light emitting diodes.

In a case where the OLED display is employed as the display device 100 according to aspects of the present disclosure, each sub-pixel SP may include an organic light emitting diode (OLED) where the OLED itself emits light as a light emitting element. In a case where the QD display is employed as the display device 100 according to aspects of the present disclosure is, each sub-pixel SP may include a light emitting element including a quantum dot, which is a self-emissive semiconductor crystal. In a case where the micro LED display is employed as the display device 100 according to aspects of the present disclosure, each sub-pixel SP may include a micro LED where the micro OLED itself emits light and which is formed with an inorganic material as a light emitting element.

Figure 2:
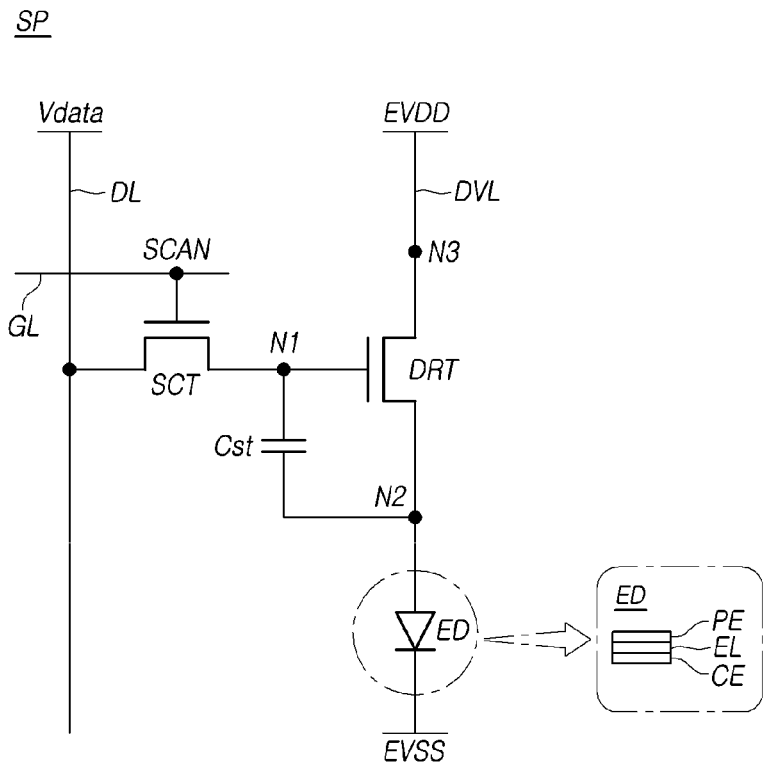
FIG. 2 illustrates an equivalent circuit of a sub-pixel used in the display device according to aspects of the present disclosure.

FIG. 2 illustrates an equivalent circuit of a sub-pixel SP used in the display device 100 according to aspects of the present disclosure.

Referring to FIG. 2, each of a plurality of sub-pixels SP disposed in the display panel 110 of the display device 100 according to aspects of the present disclosure may include a light emitting element ED, a driving transistor DRT, a scan transistor SCT, and a storage capacitor Cst.

Referring to FIG. 2, the light emitting element ED may include a pixel electrode PE and a common electrode CE, and include an emission layer EL located between the pixel electrode PE and the common electrode CE.

The pixel electrode PE of the light emitting element ED may be an electrode disposed in each sub-pixel SP, and the common electrode CE may be an electrode commonly disposed in all or some of the sub-pixels SP. Here, the pixel electrode PE may be an anode electrode and the common electrode CE may be a cathode electrode. In another embodiment, the pixel electrode PE may be the cathode electrode and the common electrode CE may be the anode electrode.

In one embodiment, the light emitting element ED may be an organic light emitting diode (OLED), a light emitting diode (LED), a quantum dot light emitting element or the like.

The driving transistor DRT may be a transistor for driving the light emitting element ED, and may include a first node N1, a second node N2, a third node N3, and the like.

The first node N1 of the driving transistor DRT may be a gate node of the driving transistor DRT, and may be electrically connected to a source node or a drain node of the scan transistor SCT. The second node N2 of the driving transistor DRT may be a source node or a drain node of the driving transistor DRT. The second node N2 may be connected to the pixel electrode PE of the light emitting element ED. The third node N3 of the driving transistor DRT may be electrically connected to a driving voltage line DVL for supplying a driving voltage EVDD.

The scan transistor SCT can be controlled by a scan signal SCAN, which is a type of gate signal, and may be connected between the first node N1 of the driving transistor DRT and a data line DL. In other words, the scan transistor SCT can be turned on or off according to the scan signal SCAN supplied through a scan signal line SCL, which is a type of the gate line GL, and control an electrical connection between the data line DL and the first node N1 of the driving transistor DRT.

The scan transistor SCT can be turned on by a scan signal SCAN having a turn-on level voltage, and passes a data voltage Vdata supplied through the data line DL to the first node of the driving transistor DRT.

In one embodiment, when the scan transistor SCT is an n-type transistor, the turn-on level voltage of the scan signal SCAN may be a high level voltage. In another embodiment, when the scan transistor SCT is a p-type transistor, the turn-on level voltage of the scan signal SCAN may be a low level voltage.

The storage capacitor Cst may be connected between the first node N1 and the second node N2 of the driving transistor DRT. The storage capacitor Cst can store the amount of electric charge corresponding to a voltage difference between both terminals and maintain the voltage difference between both terminals for a predetermined frame time or selected time frame. Accordingly, a corresponding sub-pixel SP can emit light for the predetermined frame time or the selected time frame.

Figure 3:
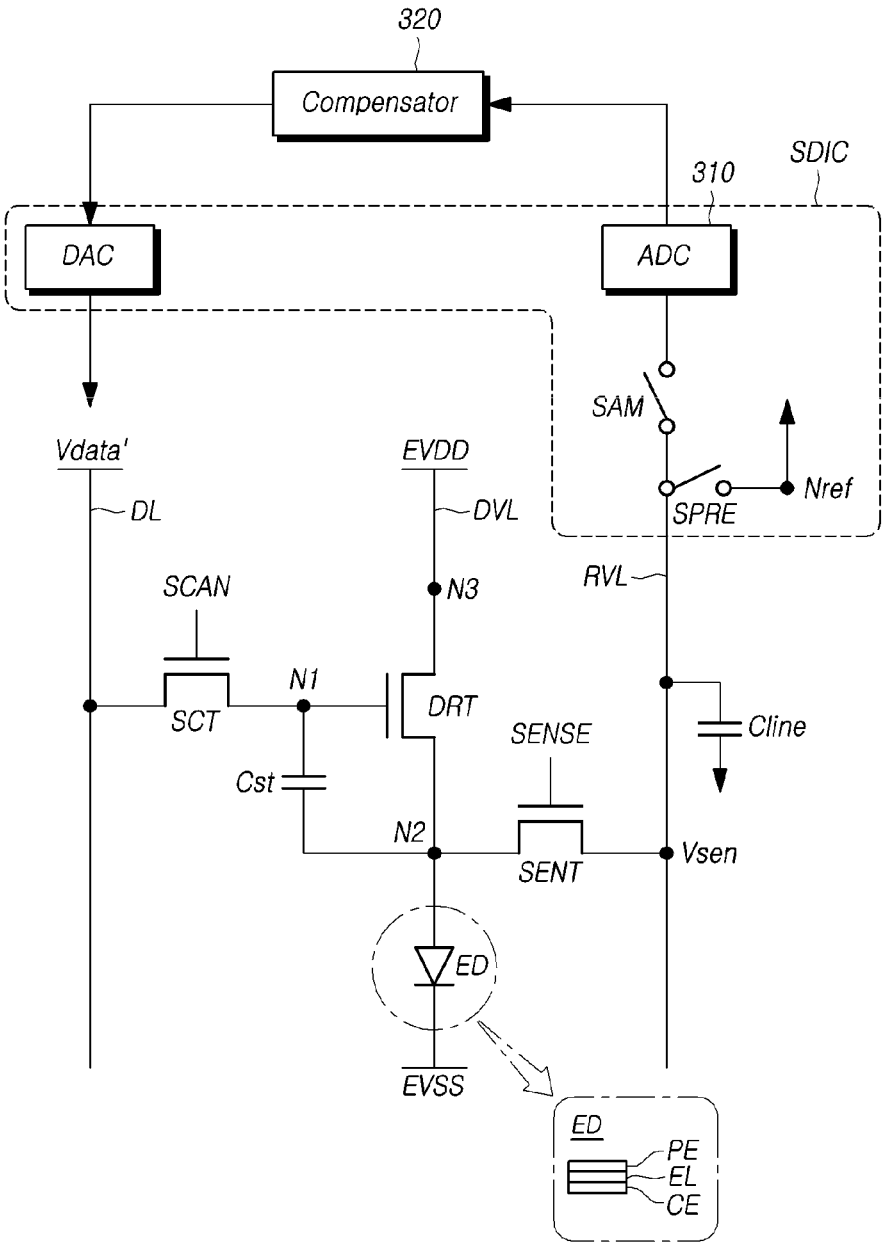
FIG. 3 illustrates a sensing circuit of a sub-pixel applied to the display device according to aspects of the present disclosure.

FIG. 3 illustrates a sensing circuit of a sub-pixel SP used in the display device 100 according to aspects of the present disclosure.

Referring to FIG. 3, each of the plurality of sub-pixels SP disposed in the display panel 110 of the display device 100 according to aspects of the present disclosure may further include a sensing transistor SENT.

The sensing transistor SENT can be controlled by a sense signal SENSE, which is a type of gate signal, and may be connected between the second node N2 of the driving transistor DRT and a reference voltage line RVL. In other words, the sensing transistor SENT can be turned on or off according to the sense signal SENSE, and control an electrical connection between the reference voltage line RVL and the second node N2 of the driving transistor DRT.

The sensing transistor SENT can be turned on by a sense signal SENSE having a turn-on level voltage, and pass a reference voltage Vref transmitted through the reference voltage line RVL to the second node of the driving transistor DRT.

Further, the sensing transistor SENT can be turned on by the sense signal SENSE having the turn-on level voltage, and transmit a voltage at the second node N2 of the driving transistor DRT to the reference voltage line RVL.

In one embodiment, when the sensing transistor SENT is an n-type transistor, the turn-on level voltage of the sense signal SENSE may be a high level voltage. In another embodiment, when the sensing transistor SENT is a p-type transistor, the turn-on level voltage of the sense signal SENSE may be a low level voltage.

The function of the sensing transistor SENT transmitting the voltage at the second node N2 of the driving transistor DRT to the reference voltage line RVL may be used when sensing at least one characteristic value of the sub-pixel SP. In this case, the voltage transmitted to the reference voltage line RVL may be a voltage for calculating at least one characteristic value of the sub-pixel SP or a voltage in which the at least one characteristic value of the sub-pixel SP is reflected.

Herein, the characteristic value of the sub-pixel SP may be a characteristic value of the driving transistor DRT or the light emitting element ED. The characteristic value of the driving transistor DRT may include a threshold voltage and/or mobility of the driving transistor DRT. The characteristic value of the light emitting element ED may include a threshold voltage of the light emitting element ED.

The driving transistor DRT, the scan transistor SCT, and the sensing transistor SENT may n-type transistors, p-type transistors, or combinations thereof. Herein, for convenience of description, it is assumed that the driving transistor DRT, the scan transistor SCT, and the sensing transistor SENT are n-type transistors.

The storage capacitor Cst may be an external capacitor intentionally designed to be located outside of the driving transistor DRT, other than an internal capacitor, such as a parasitic capacitor (e.g., a Cgs, a Cgd), that may be formed between the gate node and the source node (or drain node) of the driving transistor DRT.

The respective gate nodes of the scan transistor SCT and the sense transistor SENT may be connected to gate lines GL different from each other. In some embodiments, the scan signal SCAN and the sense signal SENSE may be separate gate signals, and the on-off timing of the scan transistor SCT and the on-off timing of the sensing transistor SENT in one sub-pixel SP may be independent. That is, the on-off timing of the scan transistor SCT and the on-off timing of the sensing transistor SENT in one sub-pixel SP may be equal to, or different from, each other.

In another embodiment, the respective gate nodes of the scan transistor SCT and the sense transistor SENT may be commonly connected to an identical gate line GL. In this embodiment, the scan signal SCAN and the sense signal SENSE may be the same gate signal, and the on-off timing of the scan transistor SCT and the on-off timing of the sensing transistor SENT in one sub-pixel SP may be the same.

The sub-pixel structure of FIG. 2 may be referred to as a 2T (Transistor) and 1C (Capacitor) structure, and the sub-pixel structure of FIG. 3 may be referred to as a 3T and 1C structure. It should be understood that the sub-pixel structures of FIGS. 2 and 3 are merely examples of possible sub-pixel structures for convenience of discussion, and embodiments of the present disclosure may be implemented in any of various structures, as desired. For example, the sub-pixel may further include at least one transistor and/or at least one capacitor.

Further, discussions on the sub-pixel structures of FIGS. 2 and 3 have been conducted based on the assumption that a self-emissive display device is employed as the display device 100. In another embodiment, when a liquid crystal display device is employed as the display device 100, each sub-pixel SP may include a transistor, a pixel electrode, and the like.

Meanwhile, in the display device 100 according to aspects of the present disclosure, each of circuit elements, such as a light emitting element ED, a driving transistor DRT, and the like, included in each of a plurality of sub-pixels SP disposed in the display panel 110 has its own characteristic values (e.g., a threshold voltage, mobility, and the like). The circuit elements of each of the plurality of sub-pixels SP may age and become less efficient in performing their functions as the using time of the display device increases, this leading their own characteristic values to vary.

In the display device 100 according to aspects of the present disclosure, respective using times of the plurality of sub-pixels SP disposed in the display panel 110 may be different from one another. Accordingly, there may be made differences between respective characteristic values of one or more circuit elements (e.g., the light emitting element ED, the driving transistor DRT, and/or the like) respectively included in the plurality of sub-pixels SP. That is, there may be made differences in degradations between respective circuit elements included in the plurality of sub-pixels SP. Thereby, the image quality of the display device 100 may be reduced.

To address this issue, the display device 100 according to aspects of the present disclosure can include a compensation circuitry capable of sensing, and compensating for, a characteristic value difference (e.g., a threshold voltage difference or mobility difference between driving transistors DRT, a threshold voltage difference between light emitting elements ED, and the like) between sub-pixels SP.

Referring to FIG. 3, the compensation circuitry of the display device 100 according to aspects of the present disclosure can include the sub-pixel having the 3T and 1C structure as shown in FIG. 3, a sensing circuit 310, a sampling switch SAM, an initialization switch SPRE, a compensator 320, and the like.

Referring to FIG. 3, the sensing circuit 310 can measure a voltage of the reference voltage line RVL. For example, the sensing circuit 310 can convert a voltage (analog voltage) of the reference voltage line RVL into a digital value, and output the digital value resulting from the converting. That is, the sensing circuit 310 can include an analog-to-digital converter ADC.

A line capacitor Cline can be formed onto the reference voltage line RVL.

As sensing for the sub-pixel SP is driven, when a current flows through the sense transistor SENT that is turned on, electrical charge can be stored in the line capacitor Cline formed onto the reference voltage line RVL. Accordingly, a voltage corresponding to the amount of charge stored in the line capacitor Cline is applied to the reference voltage line RLV. The voltage applied to the reference voltage line RLV can be sensed by the sensing circuit 310.

The sampling switch SAM can control a connection between the sensing circuit 310 and the reference voltage line RVL.

The initialization switch SPRE can control a connection between the reference voltage line RVL and a reference voltage supply node Nref. Here, the reference voltage supply node Nref is a node to which the reference voltage Vref is supplied.

The sensing circuit 310 can sense a voltage of the reference voltage line RVL for detecting at least one characteristic value (e.g., a threshold voltage or mobility of the driving transistor DRT, a threshold voltage of the light emitting element ED, etc.) of each of the plurality of sub-pixels SP, generate sensing data based on the sensed voltage Vsen, and output the generated sensing data.

The compensator 320 can determine at least one characteristic value of each sub-pixel SP using the sensing data output from the sensing circuit 310, and based on this, perform a compensation process for compensating for a difference in characteristic values between sub-pixels.

Here, the characteristic value of the sub-pixel is a characteristic value of a circuit element within the sub-pixel, and may be, for example, the threshold voltage or mobility of the driving transistor DRT, or the threshold voltage of the light emitting element ED. A difference in characteristic values between sub-pixels may be, for example, a threshold voltage difference or mobility difference between corresponding driving transistors DRT, or a threshold voltage difference between corresponding light emitting elements ED.

The initialization switch SPRE is a switch for controlling a voltage applied to the second node N2 of the driving transistor DRT so that the second node N2 of the driving transistor DRT in the sub-pixel SP can be in a voltage state that reflects a desired characteristic value of a corresponding circuit element.

When the initialization switch SPRE is turned on, the reference voltage Vref can be supplied to the reference voltage line RVL, and then, applied to the second node N2 of the driving transistor DRT through the sense transistor SENT that has been turned on.

As the sampling switch SAM is turned on, the reference voltage line RVL and the sensing circuit 310 can be electrically connected.

The on-off timing of the sampling switch SAM can be controlled such that the sampling switch SAM is turned on when a voltage of the second node N2 of the driving transistor DRT in the sub-pixel SP or the reference voltage line RVL reaches a voltage that reflects a desired characteristic value of a corresponding circuit element.

When the sampling switch SAM is turned on, the sensing circuit 310 can sense a voltage of the connected reference voltage line RVL.

When the sensing circuit 310 senses the voltage of the reference voltage line RVL, if the resistance of the sense transistor SENT can be ignored in a situation where the sense transistor SENT is turned on, a voltage Vsen sensed by the sensing circuit 310 may correspond to the voltage of the second node N2 of the driving transistor DRT or the voltage of a pixel electrode PE of the light emitting device ED.

In a situation where the line capacitor Cline is formed onto the reference voltage line RVL, the voltage sensed by the sensing circuit 310 may be a voltage charged in the line capacitor Cline formed onto the reference voltage line RVL. Here, the reference voltage line RVL may be also referred to as a sensing line.

For example, the voltage Vsen sensed by the sensing circuit 310 may be a voltage value (Vdata-Vth or Vdata-ΔVth, here, the Vdata is a data voltage of the driving transistor DRT driven for sensing) including a threshold voltage Vth, or a threshold voltage difference ΔVth, of the driving transistor DRT, or a voltage value for sensing the mobility of the driving transistor DRT.

In another example, the voltage Vsen sensed by the sensing circuit 310 may be a voltage that reflects a threshold voltage of the light emitting device ED, and may be a voltage representing a degree to which the light emitting device ED is degraded.

The sensing circuit 310 can convert the sensed voltage Vsen into a digital sensing value and supply sensing data including the converted sensing value to the compensator 320.

Using the sensing data for each sub-pixel SP, the compensator 320 can determine characteristic values (the threshold voltages or mobility of driving transistors DRT, the threshold voltages of light emitting elements ED), or a variance in the characteristic values, of the sub-pixels SP, generate respective compensation values of the sub-pixels SP for reducing or eliminating differences in characteristic values between the sub-pixels, and store the generated compensation values in a memory.

The controller 123 can modify data to be supplied to each sub-pixel SP by using the compensation value of each sub-pixel SP, and output the modified data.

In turn, the source driver integrated circuit SDIC of the data driving circuit 121 can receive the modified data from the controller 123, convert the modified data to a data voltage Vdata in an analog form by using the digital-to-analog converter DAC, and output the resulting data voltage Vdata to a corresponding data line DL. In this manner, the compensation for at least one characteristic value of at least one circuit element of each sub-pixel SP can be performed.

In one embodiment, one reference voltage line RVL may be disposed on a sub-pixel column basis or may be disposed on two or more sub-pixel columns basis.

For example, in a case where one pixel includes 4 sub-pixels (a red sub-pixel, a white sub-pixel, a green sub-pixel, and a blue sub-pixel), one reference voltage line RVL may be disposed in each pixel column including 4 sub-pixel columns (a red sub-pixel column, a white sub-pixel column, a green sub-pixel column, and a blue sub-pixel column).

The sensing circuit 310, the initialization switch SPRE, and the sampling switch SAM may be included inside of the source driver integrated circuit SDIC included in the data driving circuit 121. In another embodiment, the sensing circuit 310, the initialization switch SPRE, and the sampling switch SAM may be disposed outside of the source driver integrated circuit SDIC.

The compensator 320 may be included inside of the controller 123. In another embodiment, the compensator 320 may be disposed outside of the controller 123. The compensator 320 may further include a memory for storing sensing data and compensation values.

As described above, in the display device 100 according to aspects of the present disclosure, as respective using times of the plurality of sub-pixels SP are different from one another, there are caused differences in respective characteristic values of circuit elements (a light emitting element ED, a driving transistor DRT, and the like) respectively included in the plurality of sub-pixels SP. That is, there may be made differences in degradations between respective circuit elements included in the plurality of sub-pixels SP. Thereby, the image quality of the display device 100 according to aspects of the present disclosure may be reduced.

In a situation where an identical object image is continuously displayed in a specific area (e.g., a corner area, an edge area, etc.) of the display panel 110, an afterimage resulting from the object image may be still displayed even when the object image continuously having been displayed in the specific area disappears.

For example, one or more object images of a logo, a subtitle, content information, broadcasting information, and the like may be continuously displayed for a long time in the specific area (e.g., the corner area, the edge area, etc.) of the display panel 110. Due to this, one or more afterimages resulting from the one or more object images of the logo, the subtitle, the content information, the broadcasting information, and the like may be displayed in the specific area (e.g., the corner area, the edge area, etc.) of the display panel 110.

This is because degradation differences between sub-pixels SP included in the specific area (e.g., the corner area, the edge area, etc.) of the display panel 110 is greater than degradation differences between sub-pixels SP included in another area of the display panel 110.

To solve this problem, the display device 100 according to aspects of the present disclosure can provide a driving method capable of improving the uniformity of degradation in the display panel 110. Hereinafter, a driving method for restoring the uniformity of degradation in the display device 100 will be described.

Figure 4:
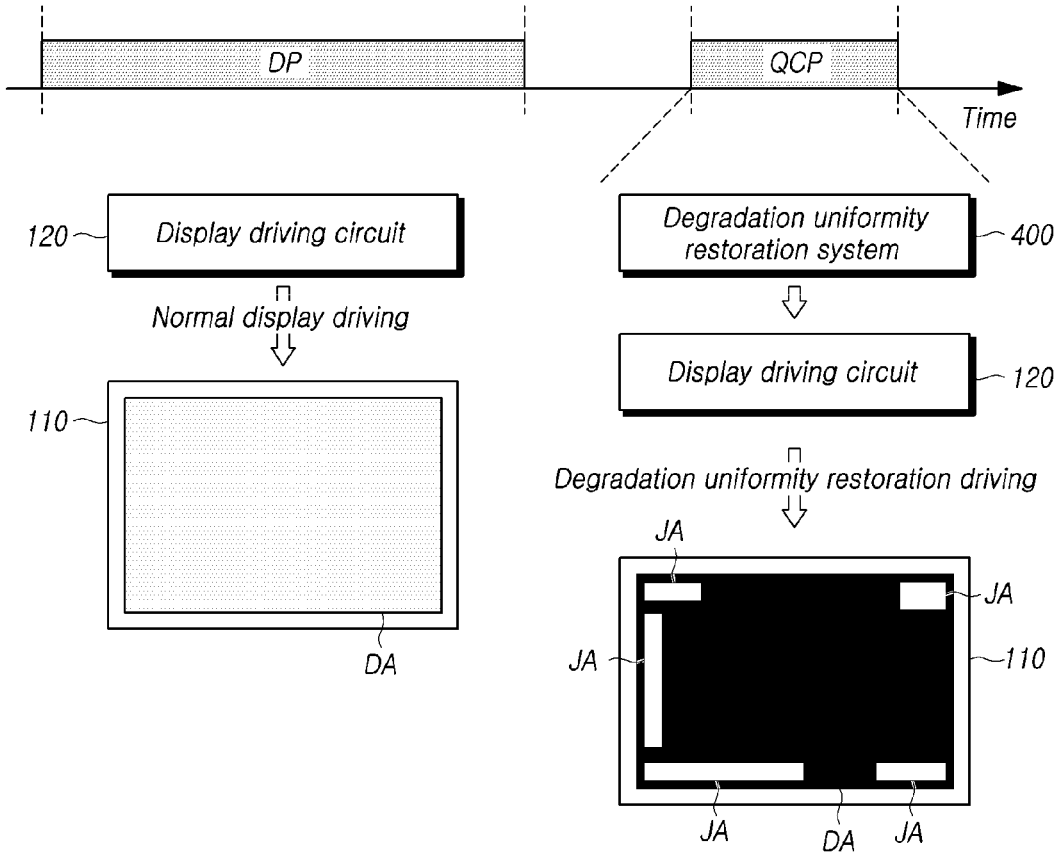
FIG. 4 illustrates degradation uniformity restoration driving of the display device according to aspects of the present disclosure.
Figure 5:
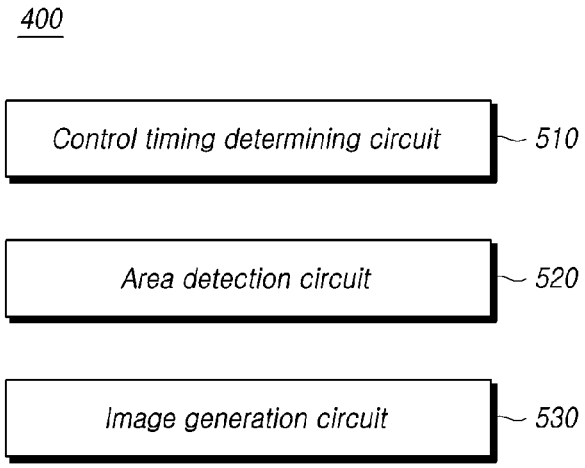
FIG. 5 illustrates a system for the degradation uniformity restoration driving of the display device according to aspects of the present disclosure.

FIG. 4 illustrates degradation uniformity restoration driving of the display device 100 according to aspects of the present disclosure. FIG. 5 illustrates a degradation uniformity restoration system 400 of the display device 100 according to aspects of the present disclosure.

Referring to FIG. 4, the display driving circuit 120 of the display device 100 according to aspects of the present disclosure can perform a display driving for displaying a normal image in the display area DA of the display panel 110 during a normal display period DP.

Referring to FIG. 4, the display device 100 can include the degradation uniformity restoration system 400 capable of improving the entire degradation uniformity of the display panel 110.

Referring to FIG. 4, the degradation uniformity restoration system 400 can detect an area (hereinafter, referred to as an afterimage occurrence predicted area JA) of the display panel 110 in which a large degradation difference is made, and perform a degradation uniformity restoration driving process for the detected afterimage occurrence prediction area.

Referring to FIG. 4, the degradation uniformity restoration system 400 of the display device 100 according to aspects of the present disclosure can perform degradation uniformity restoration driving by interworking with the display driving circuit 120 during an image quality control period QCP different from the normal display period DP.

The degradation uniformity restoration system 400 can drive the display panel 110 by interworking with the display driving circuit 120 so that a degradation uniformity restoration image can be displayed in one or more afterimage occurrence predicted areas JA detected in the display panel 110 during the image quality control period QCP. Here, the degradation uniformity restoration image may be generated differently depending on a degradation state of a corresponding afterimage occurrence predicted area JA.

The degradation uniformity restoration system 400 can control the display panel 110 by interworking with the display driving circuit 120 so that an area (afterimage occurrence non-predicted area) other than an afterimage occurrence predicted area JA in the display panel 110 does not emit light during the image quality control period QCP. For example, the display driving circuit 120 can supply a gate signal of a turn-off level voltage to gate lines GL disposed in an area (afterimage occurrence non-predicted area) other than an afterimage occurrence predicted area JA, or supply a black data voltage to data lines DL disposed in the area other than the afterimage occurrence predicted area JA.

Referring to FIG. 5, the degradation uniformity restoration system 400 of the display device 100 according to aspects of the present disclosure can include a control timing determining circuit 510 capable of determining a period during which the display surface (screen) of the display panel 110 is not exposed to users as an image quality control period QCP. Description of the display panel 110 as being "not exposed" may refer to a state in which the display surface of the display panel 110 is substantially not visible to the user. For example, when the display panel 110 is a foldable display panel, the display panel 110 may be folded in such a manner that the display surface is hidden while a back surface opposite the display surface is exposed. Similarly, when the display panel 110 is a rollable display panel, the display panel 110 may be rolled such that the back surface faces the user (e.g., is exposed) and the display surface faces inward and is hidden from (e.g., is not exposed to) the user.

In some embodiments, the time period of the display panel 110 as being "not exposed" may also include a time period when the display is off, for example, it might be turned off with respect displaying an image and the screen or that particular pixel and/or sub-pixel not be outputting light, but can still have power provided to it.

Referring to FIG. 5, the degradation uniformity restoration system 400 of the display device 100 according to aspects of the present disclosure can include an area detection circuit 520 capable of determining a degradation state of each of a plurality of sub-pixels SP based on accumulated current data in each sub-pixel SP, and detecting one or more areas having a degradation difference greater than or equal to a predetermined threshold level or selected threshold level (or simply, "threshold level") as an afterimage occurrence predicted area JA.

Referring to FIG. 5, the degradation uniformity restoration system 400 of the display device 100 according to aspects of the present disclosure can include an image generation circuit 530 capable of generating one or more degradation uniformity restoration images to be displayed in one or more afterimage occurrence predicted areas JA.

One or more of the control timing determining circuit 510, the area detection circuit 520, and the image generation circuit 530 included in the degradation uniformity restoration system 400 of the display device 100 according to aspects of the present disclosure can interwork with the data driving circuit 121 and the gate driving circuit 122 included in the display driving circuit 120.

One or more of the control timing determining circuit 510, the area detection circuit 520, and the image generation circuit 530 included in the degradation uniformity restoration system 400 of the display device 100 according to aspects of the present disclosure can be controlled by the controller 123 included in the display driving circuit 120, or be included in the controller 123.

Figure 6:
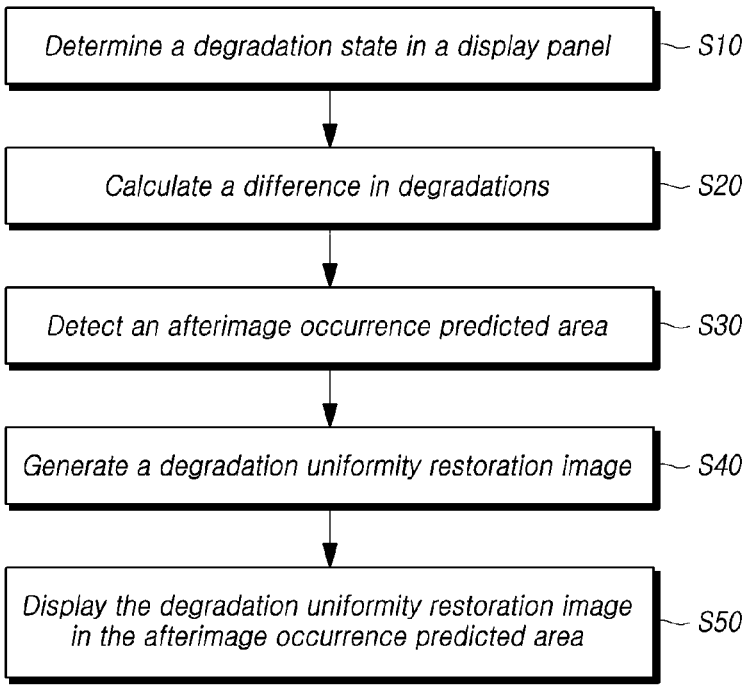
FIG. 6 is a flow diagram illustrating the degradation uniformity restoration driving of the display device according to aspects of the present disclosure.

FIG. 6 is a flow diagram illustrating the degradation uniformity restoration driving of the display device 100 according to aspects of the present disclosure.

Referring to FIG. 6, the driving method for restoring the uniformity of degradation of the display device 100 according to aspects of the present disclosure can include determining a degradation state for each of sub-pixels SP in the display panel 110, at step S10, calculating differences in degradations between the sub-pixels SP, at step S20, detecting an afterimage occurrence predicted area JA using results obtained by calculating the degradation differences, at step S30, generating a degradation uniformity restoration image to be displayed in the afterimage occurrence predicted area JA, at step S40, and during an image quality control period QCP, displaying the degradation uniformity restoration image in the afterimage occurrence predicted area JA, at step S50.

In step S10, the display device 100 can determine the degradation state of each of the plurality of sub-pixels SP based on accumulated current data in each of the plurality of sub-pixels SP disposed in the display panel 110. Here, in step S10, the display device 100 can determine the degradation state using sensing data reflecting a degradation state in each of the plurality of sub-pixels SP using the circuit shown in FIG. 3. In another embodiment, the display device 100 can determine the degradation state by using accumulated current data of each of the plurality of sub-pixels SP stored in the memory in advance or degradation information on each of the plurality of sub-pixels SP calculated from the pre-stored accumulated current data.

In step S20, for example, the display device 100 can calculate differences in degradations between the sub-pixels SP based on a difference in the amounts of accumulated current of the plurality of sub-pixels SP.

In step S30, the display device 100 can detect one or more areas including sub-pixels SP having a degradation difference greater than or equal to a predetermined threshold level or selected threshold level (or simply, "threshold level") as an afterimage occurrence predicted area JA.

In step S40, the image generation circuit 530 of the display device 100 can generate a degradation uniformity restoration image that is opposite to a degradation state of each of sub-pixels SP included in the afterimage occurrence predicted area JA. Here, the generation of the degradation uniformity restoration image by the image generation circuit 530 of the display device 100 may be indicative of generating data to be supplied to each of sub-pixels SP included in the afterimage occurrence predicted area JA. The image generation circuit 530 may be the controller 123 or may be included in the controller 123.

In step S50, the display device 100 can display the degradation uniformity restoration image generated at step S40 in the afterimage occurrence predicted area JA during the image quality control period QCP.

For example, when it is assumed that sub-pixels included in the afterimage occurrence predicted area JA may include a first sub-pixel SP and a second sub-pixel SP, and the first sub-pixel SP is in a more degraded state than the second sub-pixel SP, the degradation uniformity restoration image to be displayed in the afterimage occurrence predicted area JA may be an image for intentionally more accelerating the degradation of the less degraded second sub-pixel SP, and for less accelerating the degradation of the more degraded first sub-pixel SP or for not driving the more degraded first sub-pixel SP.

Here, the state in which the first sub-pixel SP is more degraded than the second sub-pixel SP may indicate that a variance in at least one characteristic value of circuit elements (e.g., a light emitting element ED, a driving transistor DRT, and/or the like) of the first sub-pixel SP is larger than a variance in at least one characteristic value of circuit elements (e.g., a light emitting element ED, a driving transistor DRT, and/or the like) of the second sub-pixel SP, or may indicate that the amount of accumulated current having flowed through the light emitting element ED or the driving transistor DRT of the first sub-pixel SP is greater than the amount of accumulated current having flowed through the light emitting element ED or the driving transistor DRT of the second sub-pixel SP.

In other words, the state in which the first sub-pixel SP is more degraded than the second sub-pixel SP before the image quality control period QCP may indicate that the amount of accumulated current having flowed through the first sub-pixel SP is greater than the amount of accumulated current having flowed through the second sub-pixel SP.

Here, during the image quality control period QCP, when the degradation uniformity restoration image is displayed, the intentional acceleration of the degradation of the less degraded second sub-pixel SP may indicate that the light emitting element of the second sub-pixel SP is driven to emit light brighter, or indicate that the second sub-pixel SP haves higher luminescence. Further, the non-driving of the first sub-pixel SP may indicate that the light emitting element ED of the first sub-pixel SP does not emit light.

Thus, during the image quality control period QCP, as the degradation uniformity restoration image is displayed, the amount of current flowing through the second sub-pixel SP for which the degradation accelerating process is performed may be larger than the amount of current flowing through the first sub-pixel SP. That is, during the image quality control period QCP, as the degradation uniformity restoration image is displayed, the second sub-pixel SP for which the degradation accelerating process is performed can emit light brighter than the first sub-pixel SP.

During the image quality control period QCP, due to the degradation accelerating process performed for the less degraded second sub-pixel SP, the second sub-pixel SP can be degraded greater than the more degraded first sub-pixel SP. Accordingly, after the image quality control period QCP, a degradation difference between the first sub-pixel SP and the second sub-pixel SP may be reduced.

As described above, the degradation uniformity restoration image may be an image opposite to a degradation state of each of the sub-pixels SP included in the afterimage occurrence predicted area JA. For example, a degradation uniformity restoration image displayed in an afterimage occurrence predicted area JA during the image quality control period QCP may be an image, i.e., a reversed pattern image, obtained by reversing brightness of an image that was displayed in the afterimage occurrence predicted area JA during the normal display period NDP before the image quality control period QCP.

Figure 7:
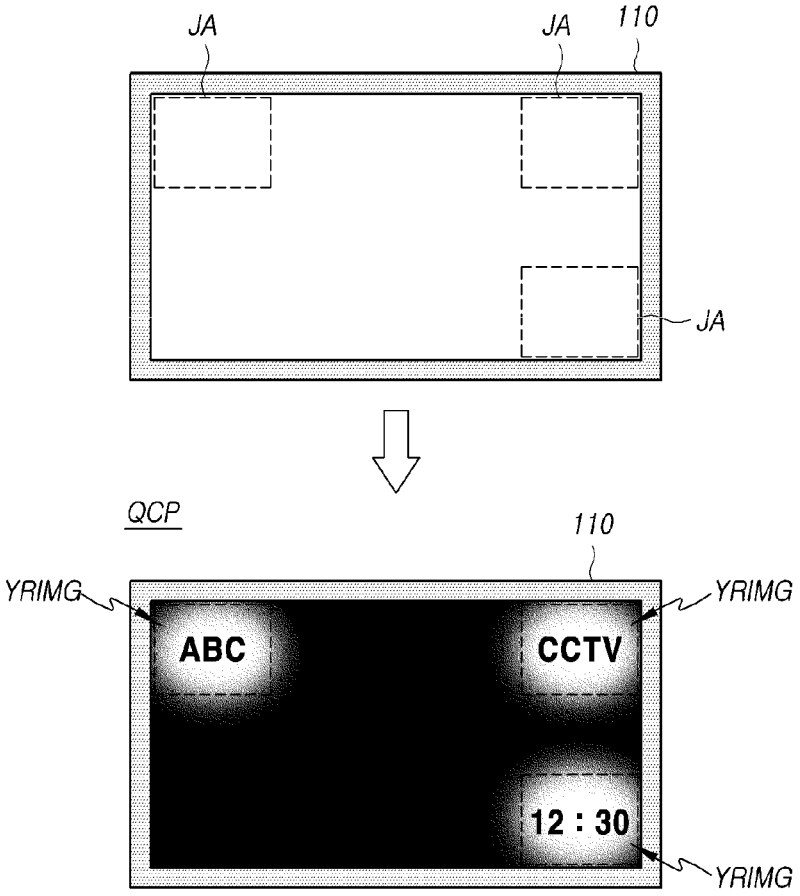
FIG. 7 illustrates an afterimage occurrence predicted area and a degradation uniformity restoration image for the degradation uniformity restoration driving in the display device according to aspects of the present disclosure.

FIG. 7 illustrates an afterimage occurrence predicted area JA and a degradation uniformity restoration image YRIMG for the degradation uniformity restoration driving in the display device 100 according to aspects of the present disclosure.

Referring to FIG. 7, for the degradation uniformity restoration driving, the display device 100 according to aspects of the present disclosure can detect one or more afterimage occurrence predicted areas JA having afterimage occurrence likelihood of a certain level or more in the display panel 110.

For example, the display device 100 can determine a degradation state of each of a plurality of sub-pixels SP disposed in the display panel 110 based on accumulated current data in each sub-pixel SP, and detect one or more areas having a degradation difference equal to or greater than a threshold level determined in advance as an afterimage occurrence predicted area JA.

Referring to FIG. 7, during the image quality control period QCP, one or more degradation uniformity restoration images YRIMG can be displayed in one or more afterimage occurrence predicted areas JA in the display panel 110.

Referring to FIG. 7, during the image quality control period QCP, an area (afterimage occurrence non-predicted area) other than the one or more afterimage occurrence predicted areas JA in the display panel 110 may be controlled not to emit light.

To do this, during the image quality control period QCP, the display driving circuit 120 can drive the display panel 110 so that one or more degradation uniformity restoration images YRIMG can be displayed in the one or more afterimage occurrence predicted areas JA in the display panel 110, but the light emitting elements ED of sub-pixels SP included in an afterimage occurrence non-predicted area other than the one or more afterimage occurrence predicted areas JA in the display panel 110 does not emit light.

Accordingly, during the image quality control period QCP, the display device 100 performs a degradation accelerating process for sub-pixels SP included in the one or more afterimage occurrence predicted areas JA in the display panel 110 in inverse relation to degrees to which these sub-pixels SP are degraded, and does not perform the degradation accelerating process for sub-pixels SP included in the afterimage occurrence non-predicted area other than the one or more afterimage occurrence predicted areas JA in the display panel 110.

Referring to FIG. 7, during the image quality control period QCP, the one or more afterimage occurrence predicted areas JA detected in the display panel 110 may be areas with high likelihood of afterimage occurrence, for example, areas in which during the normal display period NDP before the image quality control period QCP, one or more object images of a logo, a subtitle, content information, broadcasting information, and the like were displayed.

Figure 8:
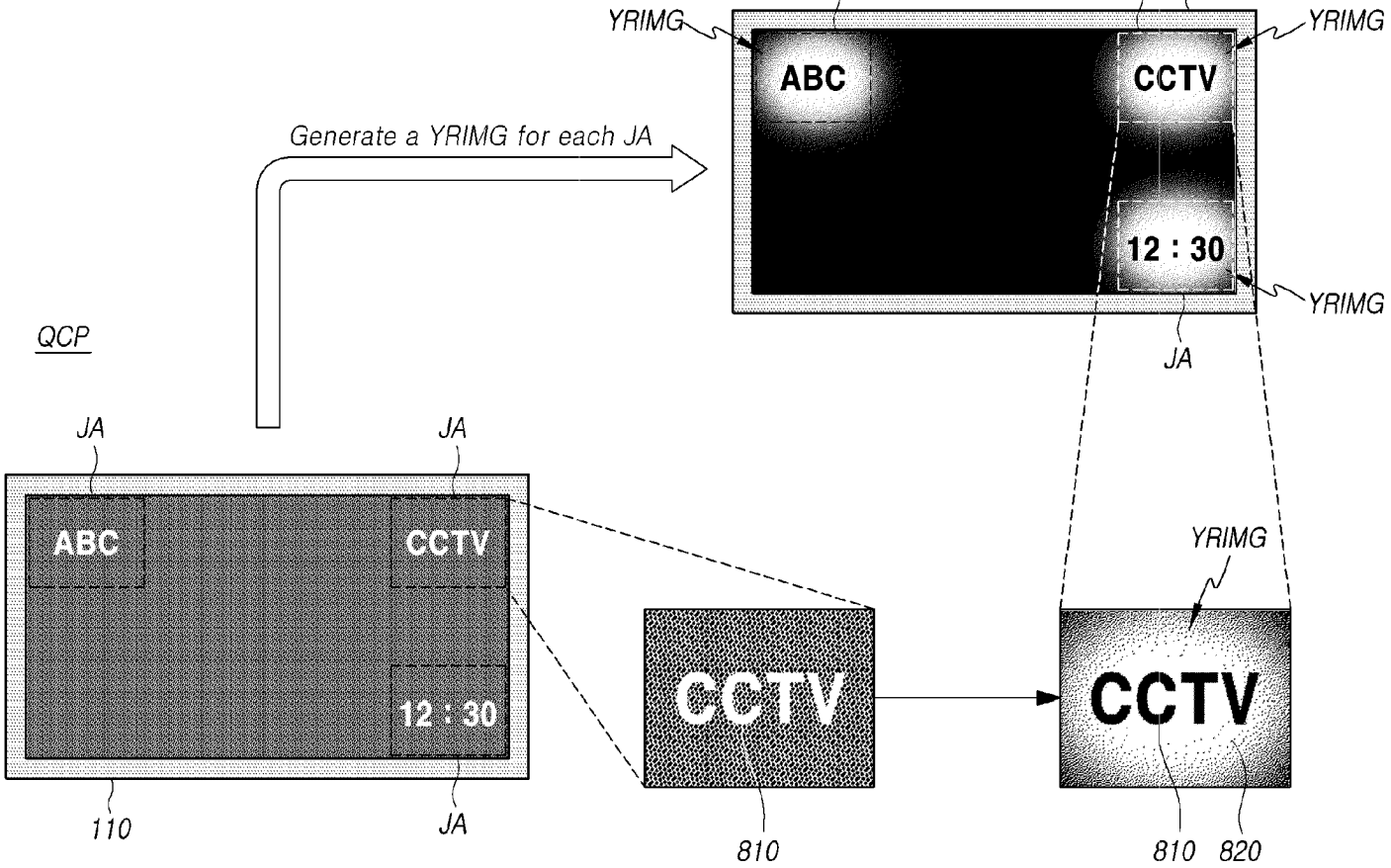
FIG. 8 illustrates generating a degradation uniformity restoration image for the degradation uniformity restoration driving of the display device according to aspects of the present disclosure.

FIG. 8 illustrates generating a degradation uniformity restoration image YRIMG for the degradation uniformity restoration driving of the display device 100 according to aspects of the present disclosure.

Referring to FIG. 8, the degradation uniformity restoration system 400 of the display device 100 can determine a degree of degradation for each sub-pixel SP based on the amount of accumulated current for the corresponding sub-pixel SP before the image quality control period QCP, and generate a degradation map 800 in which sub-pixels SP having degradation degrees exceeding a threshold degradation level among the determined degradation degrees are marked.

Referring to FIG. 8, the degradation uniformity restoration system 400 of the display device 100 can calculate degradation differences of the sub-pixels SP based on the degradation map 800, and based on the calculated degradation differences, detect one or more areas in which degradation differences are greater than or equal to a predetermined level or selected level as one or more afterimage occurrence predicted areas JA.

Referring to FIG. 8, the degradation uniformity restoration system 400 of the display device 100 can generate a degradation uniformity restoration image YRIMG to be displayed in each afterimage occurrence predicted area JA during the image quality control period QCP.

Referring to FIG. 8, during the normal display period DP, when a logo 810 of "CCTV" is displayed in the upper right corner of the display area DA of the display panel 110 for a long time, there is a probability that the degradation of the sub-pixels SP located at a point (or an area) at which the logo 810 of "CCTV" is displayed may be severely developed. That is, during the normal display period DP, when the logo 810 of "CCTV" is displayed in the upper right corner of the display area DA of the display panel 110 for a long time, a large amount of current can flow through the sub-pixels SP located at the point (or the area) at which the logo 810 of "CCTV" is displayed, thereby, leading the amount of accumulated current having flowed through the corresponding sub-pixels to increase significantly.

Referring to FIG. 8, the afterimage occurrence predicted area JA in the upper right corner of the display panel 110 can be detected by including the point (or the area) where the logo 810 of "CCTV" is displayed. Referring to FIG. 8, a degradation uniformity restoration image YRIMG to be displayed in the afterimage occurrence predicted area JA in the upper right corner may be an image in which the brightness of the logo 810 of "CCTV" and its surroundings 820 is reversed.

Figure 9:
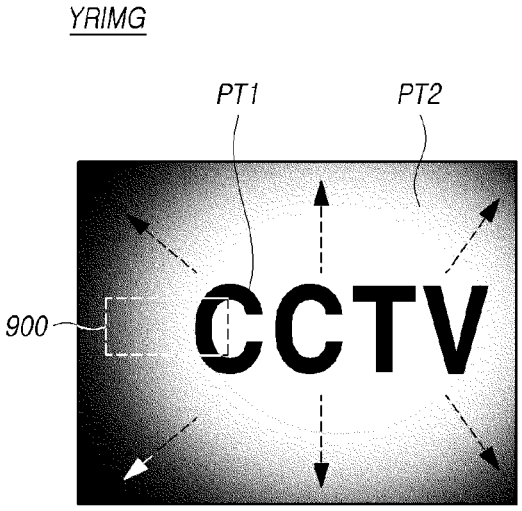
FIGS. 9 and 10 illustrate a degradation acceleration control for the degradation uniformity restoration driving of the display device according to aspects of the present disclosure.
Figure 10:
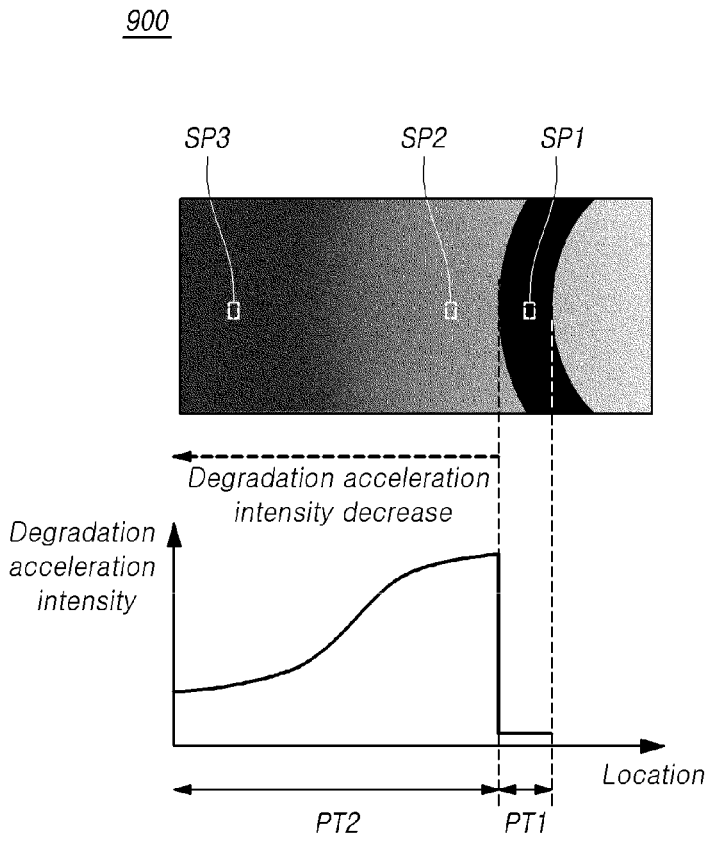

FIGS. 9 and 10 illustrates the degradation acceleration control for the degradation uniformity restoration driving of the display device 100 according to aspects of the present disclosure. FIG. 10 is an enlargement of a partial area 900 of a degradation uniformity restoration image YRIMG of FIG. 9.

Referring to FIGS. 9 and 10, the degradation uniformity restoration image YRIMG may include a first portion PT1 in which a darkest image is present, and a second portion PT2 outside of the first portion PT1. The second portion may become brighter as it moves toward the first portion, and may become darker as it moves away from the first portion.

Referring to FIGS. 9 and 10, in the degradation uniformity restoration image YRIMG, the first portion PT1 may be an area in which an object image such as the logo 810, etc., has been displayed for a long time. In the degradation uniformity restoration image YRIMG, the first portion PT1 is an area in which most degraded sub-pixels SP are located before the image quality control period QCP.

Referring to FIGS. 9 and 10, the first sub-pixel SP1 may be located in the first portion PT1 displayed with darkest brightness in the degradation uniformity restoration image YRIMG, and the second sub-pixel SP2 may be located in the second portion PT2 in the degradation uniformity restoration image YRIMG.

Referring to FIGS. 9 and 10, before the image quality control period QCP, the first sub-pixel SP1 and the second sub-pixel SP2 included in the afterimage occurrence predicted area JA may have different degradation states.

More specifically, before the image quality control period QCP, the first sub-pixel SP1 may be in a more degraded state than the second sub-pixel SP2. That is, before the image quality control period QCP, the first sub-pixel SP1 may have a degradation state greater than the second sub-pixel SP2.

Accordingly, before the image quality control period QCP, when comparing the respective amounts of accumulated current for the first sub-pixel SP1 and the second sub-pixel SP2, the amount of accumulated current having flowed through the first sub-pixel SP1 may be greater than the amount of accumulated current having flowed through the second sub-pixel SP2.

According to the degradation uniformity restoration driving according to embodiments of the present disclosure, during the image quality control period QCP, as shown in FIGS. 9 and 10, the degradation accelerating process may be performed in a small amount, or may not be performed, for the first portion PT1 in which the first sub-pixel SP1 is located, and may be performed in a larger amount than the first sub-pixel SP1 for the second portion PT2 in which the second sub-pixel SP2 is located.

More specifically, during the image quality control period QCP, the display driving circuit 120 can supply a degradation acceleration data voltage that causes the second sub-pixel SP2 to emit light more brightly than the first sub-pixel SP1 to the second sub-pixel, and supply a degradation deceleration data voltage that causes the first sub-pixel SP1 to emit light more darkly than the second sub-pixel SP2 to the first sub-pixel SP1 or drive the first sub-pixel SP1 not to emit light.

Accordingly, according to the degradation uniformity restoration driving according to embodiments of the present disclosure, during the image quality control period QCP, the amount of current flowing through the second sub-pixel SP2 may be larger than the amount of current flowing through the first sub-pixel SP1.

As a result, the second sub-pixel SP2 may be more degraded than the first sub-pixel SP1. Thereby, a degradation difference between the second sub-pixel SP2 and the first sub-pixel SP1 can be reduced.

Referring to FIGS. 9 and 10, the plurality of sub-pixels SP may further include a third sub-pixel SP3 included in the afterimage occurrence predicted area JA.

A distance between the third sub-pixel SP3 and the first sub-pixel SP1 may be larger than a distance between the second sub-pixel SP2 and the first sub-pixel SP1. In this situation, during the image quality control period QCP, the display driving circuit 120 can supply a degradation acceleration data voltage that causes the third sub-pixel SP3 to emit light more darkly than the second sub-pixel SP2 to the third sub-pixel SP3.

Referring to FIG. 10, according to the degradation uniformity restoration driving according to embodiments of the present disclosure, during the image quality control period QCP, the degradation acceleration processing may be performed in the greatest amount for the point (or area) at which the second portion PT2 closest to the first portion PT1 is located, and may be performed in a smaller amount as a distance from the first portion PT1 increases.

Referring to FIG. 10, the performing of the degradation acceleration processing in the greatest amount may indicate that the largest amount of current flows through the corresponding sub-pixel SP, or indicate that the highest data voltage is supplied to the corresponding sub-pixel SP, or indicate that the corresponding sub-pixel SP emits light most brightly.

Referring to FIG. 10, the performing of the degradation acceleration process in a smaller amount may indicate that the amount of current flowing through the sub-pixel SP decreases, or indicate that a data voltage supplied to the sub-pixel SP decreases, or indicate that the emission luminance of the sub-pixel SP is lowered.

Figure 11:
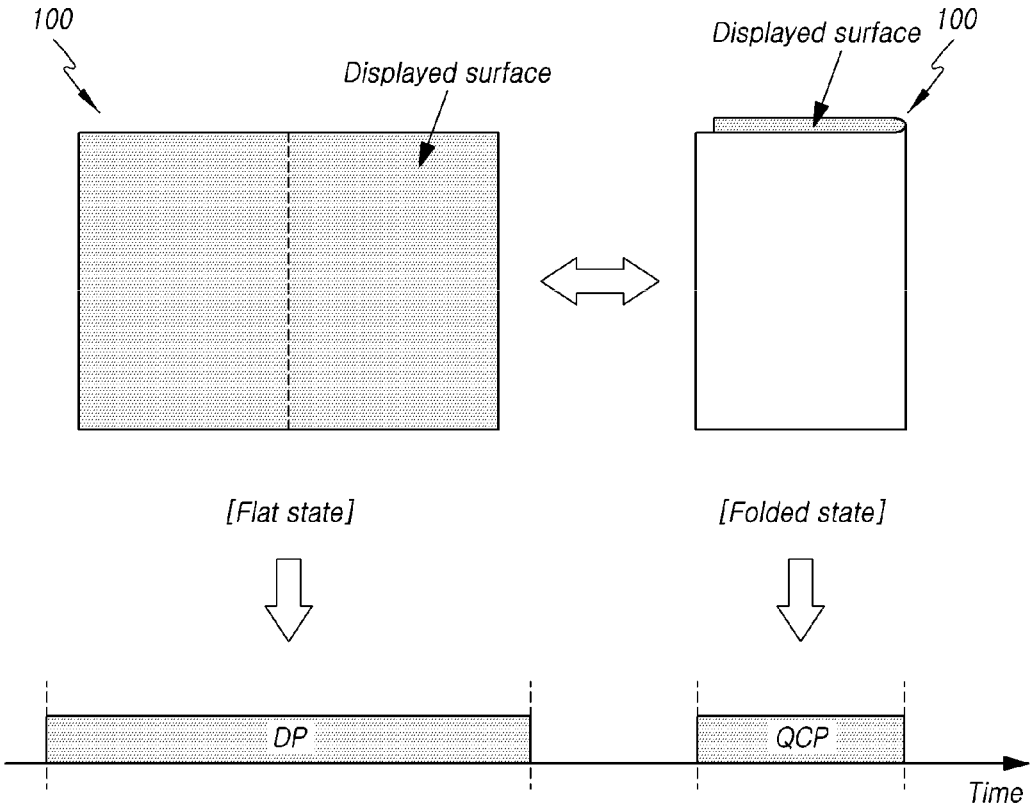
FIG. 11 illustrates, when a foldable display device is employed as the display device according to aspects of the present disclosure, a method of using a period during which the foldable display device is in a folded state as an image quality control period.

FIG. 11 illustrates, when a foldable display device is employed as the display device 100 according to aspects of the present disclosure, a method of using a period during which the foldable display device 100 is in a folded state as an image quality control period QCP.

Referring to FIG. 11, the display device 100 may be the foldable display device. The display device 100 may have a flat state or a folded state. In the flat state, the display surface of the display panel 110 can be exposed, and in the folded state, the display surface of the display panel 110 may not be exposed according to a degree to which the display surface is folded.

Referring to FIG. 11, to determine a period during which the display surface of the display panel 110 is not exposed to users as an image quality control period QCP, the display device 100 can determine a period during which the display surface (screen) of the display panel 110 is not exposed to users because the display device 100 is folded as an image quality control period QCP.

Referring to FIG. 11, when the display device 100 is in the flat state, the display device 100 may be in a normal display period DP during which images are normally displayed on the display panel 110.

Referring to FIG. 11, when the display device 100 is in the folded state, the display device 100 may be in an image quality control period QCP during which a degradation uniformity restoration image is displayed in an afterimage occurrence predicted area JA of the display panel 110.

The display device 100 shown in FIG. 11 may be any of foldable devices including display devices, such as a TV, a monitor, and the like, and personal portable terminals, such as a smart phone, a tablet PC and the like.

Figure 12:
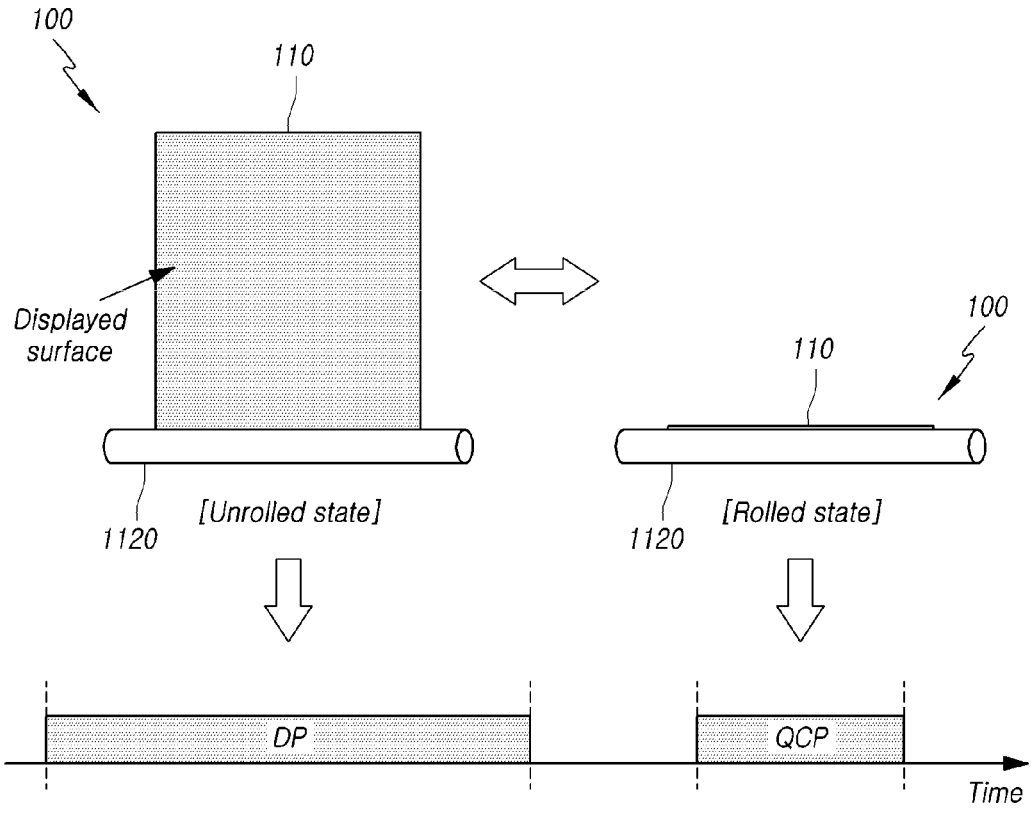
FIG. 12 illustrates, when a rollable display device is employed as the display device according to aspects of the present disclosure, a method of using a period during which the rollable display device is in a rolled state as an image quality control period.

FIG. 12 illustrates, when a rollable display device is employed as the display device 100 according to aspects of the present disclosure, a method of using a period during which the rollable display device is in a rolled state as an image quality control period QCP.

Referring to FIG. 12, the display device 100 may be the rollable display device. The display device 100 may have a state in which the display panel 110 is unrolled from a case 1120, and a state in which the display panel 110 is rolled into the case 1120. The display surface of the display panel 110 is exposed when the display panel 110 is unrolled, and the display surface of the display panel 110 is not exposed when the display panel 110 is rolled up.

Referring to FIG. 12, to determine a period during which the display surface of the display panel 110 is not exposed to users as an image quality control period QCP, the display device 100 can determine a period during which the display surface (screen) of the display panel 110 is not exposed because the display device 100 is rolled as an image quality control period QCP.

Referring to FIG. 12, when the display device 110 is in the unrolled state, the display device 100 may be in the normal display period DP during which images are normally displayed on the display panel 110.

Referring to FIG. 12, when the display device 110 is in the rolled state, the display device 100 may be in the image quality control period QCP during which a degradation uniformity restoration image is displayed in an afterimage occurrence predicted area JA of the display panel 110.

The display device 100 shown in FIG. 12 may be any of rollable devices including display devices, such as a TV, a monitor, and the like, and personal portable terminals, such as a smart phone, a tablet PC and the like.

Figure 13:
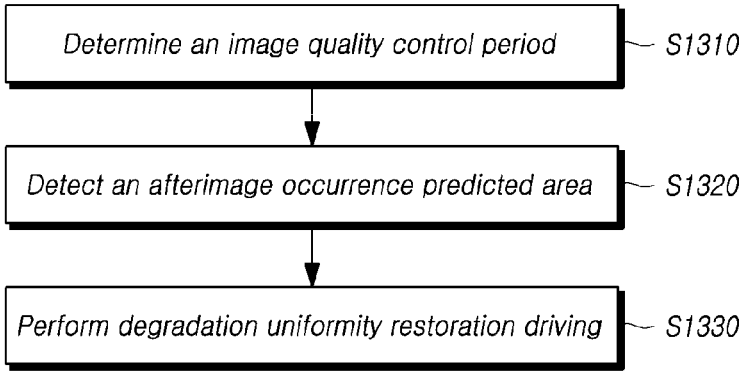
FIG. 13 is a flow diagram illustrating a method of driving the display device according to aspects of the present disclosure.

FIG. 13 is a flow diagram illustrating a method of driving the display device 100 according to aspects of the present disclosure.

The display device 100 according to aspects of the present disclosure can include a display panel 110 including a plurality of sub-pixels SP each including a light emitting element ED such as a light emitting diode, etc., and a driving transistor DRT, and a display driving circuit 120 for driving the display panel 110, and thereby, can provide a driving method capable of improving the uniformity of degradation of the display panel 110.

According to embodiments of the present disclosure, the method of driving the display device 100 can include determining an image quality control period QCP, at step S1310, and during the image quality control period QCP, driving the display panel 110 so that a degradation uniformity restoration image YRIMG can be displayed in an afterimage occurrence predicted area JA detected in the display panel 110, at step S1330.

Sub-pixels included in afterimage occurrence predicted area JA may include a first sub-pixel SP1 and a second sub-pixel SP2.

Before the image quality control period QCP, the amount of accumulated current having flowed through the first sub-pixel SP1 may be greater than the amount of accumulated current having flowed through the second sub-pixel SP2.

During the image quality control period QCP, the amount of current flowing through the second sub-pixel SP2 may be greater than the amount of current flowing through the first sub-pixel SP1.

For example, a degradation uniformity restoration image displayed in an afterimage occurrence predicted area JA during the image quality control period QCP may be an image obtained by reversing an image that was displayed in the afterimage occurrence predicted area JA during the normal display period NDP before the image quality control period QCP.

The degradation uniformity restoration image YRIMG may include a first portion in which a darkest image is present, and a second portion outside of the first portion. In this situation, the second portion may become brighter as it moves toward the first portion, and may become darker as it moves away from the first portion.

The afterimage occurrence predicted area JA may be an area in which one or more object images of a logo, a subtitle, content information, and broadcast information were displayed during the normal display period NDP before the image quality control period QCP.

The first sub-pixel SP1 and the second sub-pixel SP2 included in afterimage occurrence predicted area JA have different degradation states, but the first sub-pixel SP1 may be in a more degraded state than the second sub-pixel SP2.

In step S1330, during the image quality control period QCP, the display device 100 can supply a degradation acceleration data voltage that causes the second sub-pixel SP2 to emit light more brightly than the first sub-pixel SP1 to the second sub-pixel, and supply a degradation deceleration data voltage that causes the first sub-pixel SP1 to emit light more darkly than the second sub-pixel SP2 to the first sub-pixel SP1 or drive the first sub-pixel SP1 not to emit light.

Referring to FIG. 13, the method of driving the display device 100 according to aspects of the present disclosure may further include determining a degradation state of each of a plurality of sub-pixels SP based on accumulated current data in each sub-pixel SP, and detecting one or more areas having a degradation difference greater than or equal to a predetermined threshold level or selected threshold level (or simply, "threshold level") as an afterimage occurrence predicted area JA, at step S1320.

In step S1310, the display device 100 can determine a period during which the display surface of the display panel 110 is not exposed to users as the image quality control period QCP.

In one embodiment, the display device 100 may be a foldable display device. In this embodiment, the image quality control period QCP may be a period during which the display surface of the display panel 110 is not exposed because the display device 100 is folded.

In another embodiment, the display device 100 may be a rollable display device. In this embodiment, the image quality control period QCP may be a period during which the display surface of the display panel 110 is not exposed because the display device 100 is rolled.

The display device 100 according to the embodiments described herein can include the display panel 110 including a plurality of data lines DL and a plurality of gate lines GL, and including a plurality of sub-pixels SP each including a light emitting device ED, a driving transistor DRT, and the like, and the display driving circuit 120 capable of driving the display panel 110.

The plurality of sub-pixels SP included in the display panel 110 may include a first sub-pixel SP1 and a second sub-pixel SP2 having different degradation states, and the first sub-pixel SP1 may be in a more degraded state than the second sub-pixel SP2.

During the image quality control period QCP, the display driving circuit 120 can supply a degradation acceleration data voltage that causes the second sub-pixel SP2 to emit light more brightly than the first sub-pixel SP1 to the second sub-pixel, and supply a degradation deceleration data voltage that causes the first sub-pixel SP1 to emit light more darkly than the second sub-pixel SP2 to the first sub-pixel SP1 or drive the first sub-pixel SP1 not to emit light.

Before the image quality control period QCP, the first sub-pixel SP1 can emit light with a first luminance value in response to a first data voltage, and the second sub-pixel SP2 emit light with a second luminance value (e.g., a luminance value lower than the first luminance value) different from the first luminance value in response to the first data voltage. In this situation, a different between a reference luminance value and the first luminance value may be greater than a difference between the reference luminance value and the second luminance value.

Here, the reference luminance value may be a luminance value that a sub-pixel SP emitting light in response to the first data voltage represents when there is no degradation or immediately after the sub-pixel SP or the display panel 110 including the sub-pixel SP is rolled out.

Figure 14:
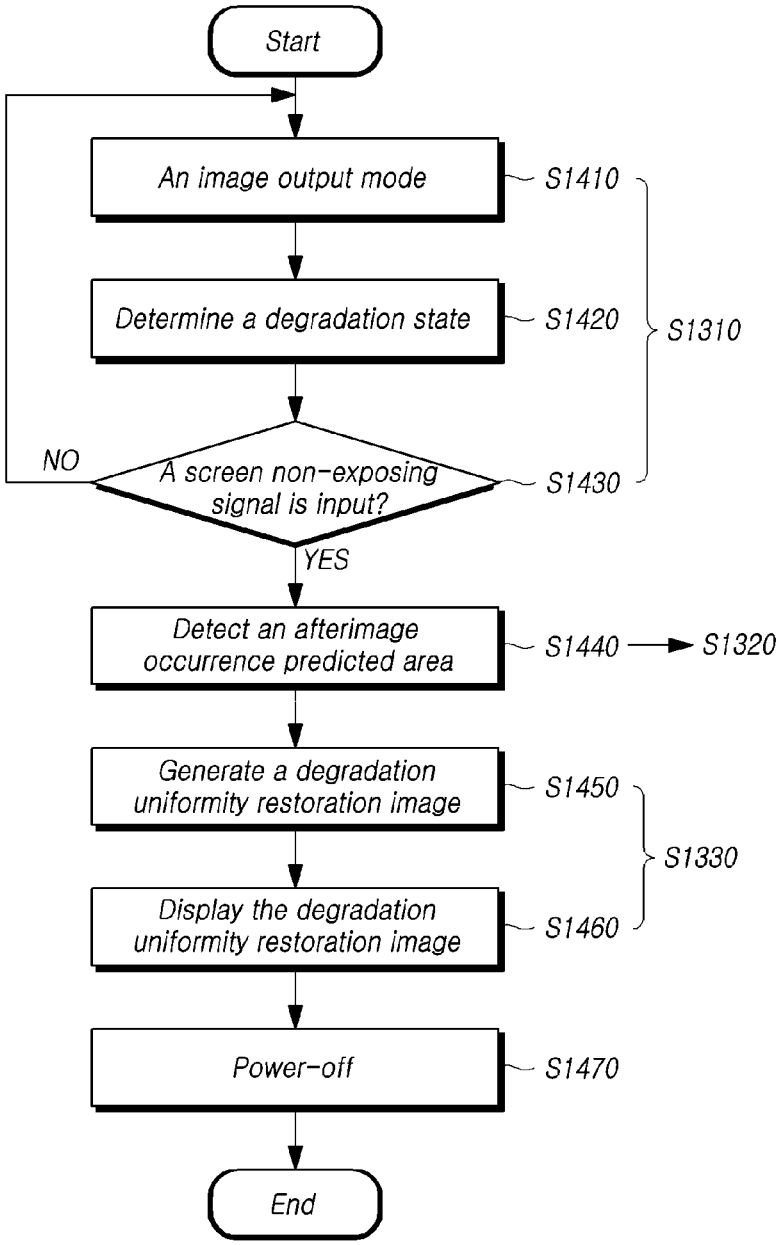
FIG. 14 is a flow chart illustrating a method of driving the display device according to aspects of the present disclosure.

FIG. 14 is a flow chart illustrating a method of driving the display device 100 according to aspects of the present disclosure.

Referring to FIG. 14, when an image output mode is initiated, as step S1410, the display device 100 can determine a degradation state of each sub-pixel SP in the display panel 110, at step S1420.

The display device 100 can monitor whether a screen non-exposing signal is input, at step S1430. Here, the screen non-exposing signal may be generated in the folded state as shown in FIG. 11 or may be generated in the state in which the display panel 110 is rolled into the case 1120 as shown in FIG. 12.

When the screen non-exposing signal is not input, the display device 100 can perform normal display driving according to the image output mode. When the screen non-exposing signal is input, the display device 100 can detect one or more afterimage occurrence predicted areas JA, at step S1440. The display device 100 can generate one or more degradation uniformity restoration images corresponding to each of the one or more afterimage occurrence predicted areas JA, at step S1450. The display device 100 can display a corresponding degradation uniformity restoration image in each of the one or more afterimage occurrence predicted areas JA, at step S1460. When a power-off signal is input, the display device 100 can perform a power-off process, at step S1470.

Steps S1410 to S1430 correspond to step S1310 of determining the image quality control period QCP in FIG. 13. Step S1440 corresponds to step S1320 of detecting the afterimage occurrence predicted area JA in FIG. 13. Steps S1450 and S1460 correspond to step S1330 of performing the degradation uniformity restoration driving in FIG. 13.

According to the embodiments described herein, it is possible to provide display devices 100 capable of improving the uniformity of degradation of the display panel, and methods of driving the display device 100. Thereby, image quality can be improved.

According to the embodiments described herein, it is possible to provide display devices 100 capable of performing degradation uniformity restoration driving in an area where an afterimage is predicted to occur without substantially driving other areas, rather than the entire area of the display panel, and method of driving the display device 100. Thereby, it is possible to reduce or minimize shortening of a lifetime of the display panel 110 through the degradation uniformity restoration driving, and reduce power consumption.

According to the embodiments described herein, it is possible to provide display devices 100 capable of performing degradation uniformity restoration driving in a time period that does not affect user's viewing and methods of driving the display device 100.

The above description has been presented to enable any person skilled in the art to make and use the technical idea of the present disclosure, and has been provided in the context of a particular application. Various modifications, additions and substitutions to the described embodiments will be readily apparent to those skilled in the art, and the general principles defined herein may be applied to other embodiments and applications without departing from the spirit and scope of the present disclosure. The above description and the accompanying drawings provide an example of the technical idea of the present disclosure for illustrative purposes. That is, the disclosed embodiments are intended to illustrate the scope of the technical idea of the present disclosure.

The various embodiments described above can be combined to provide further embodiments. All of the U.S. patents, U.S. patent application publications, U.S. patent applications, foreign patents, foreign patent applications and non-patent publications referred to in this specification and/or listed in the Application Data Sheet are incorporated herein by reference, in their entirety. Aspects of the embodiments can be modified, if necessary to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A display device comprising:

a display panel including a plurality of sub-pixels, each of the sub-pixels including a light emitting element and a driving transistor; and a display driving circuit, wherein the display driving circuit, in operation, drives the display panel to display a degradation uniformity restoration image in an afterimage occurrence predicted area detected in the display panel during an image quality control period, wherein the afterimage occurrence predicted area includes a first sub-pixel of the plurality of sub-pixels and a second sub-pixel of the plurality of sub-pixels, wherein before the image quality control period, the amount of accumulated current having flowed through the first sub-pixel is greater than the amount of accumulated current having flowed through the second sub-pixel, wherein during the image quality control period, the amount of current flowing through the second sub-pixel is greater than the amount of current flowing through the first sub-pixel, wherein the degradation uniformity restoration image includes a first portion in which a darkest image is present, and a second portion outside of the first portion, and wherein the second portion becomes brighter as the second portion moves toward the first portion, and becomes darker as the second portion moves away from the first portion.

2. The display device according to claim 1, wherein the afterimage occurrence predicted area is an area in which one or more object images of a logo, a subtitle, content information, and broadcast information were displayed during a normal display period before the image quality control period.

3. The display device according to claim 1, wherein during the image quality control period, the display driving circuit causes the degradation uniformity restoration image to be displayed in the afterimage occurrence predicted area by:

supplying a degradation acceleration data voltage to the second sub-pixel, the degradation acceleration data voltage configured to drive the second sub-pixel to emit light more brightly than the first sub-pixel, and supplying a degradation deceleration data voltage to the first sub-pixel, the degradation deceleration data voltage configured to drive the first sub-pixel to emit light more darkly than the second sub-pixel or to drive the first sub-pixel not to emit light;

wherein the degradation uniformity restoration image corresponds to a first image obtained by reversing brightness of a second image displayed in the afterimage occurrence predicted area during a normal display period before the image quality control period.

4. The display device according to claim 3, wherein the plurality of sub-pixels further includes a third sub-pixel included in the afterimage occurrence predicted area, and wherein when a distance between the third sub-pixel and the first sub-pixel is greater than a distance between the second sub-pixel and the first sub-pixel, during the image quality control period, the display driving circuit supplies a degradation acceleration data voltage to the third sub-pixel, the degradation acceleration data voltage configured to drive the third sub-pixel to emit light more darkly than the second sub-pixel.

5. The display device according to claim 1, wherein during the image quality control period, the display driving circuit drives one or more light emitting elements of one or more of the plurality of sub-pixels included in an afterimage occurrence non-predicted area outside the afterimage occurrence predicted area not to emit light.

6. The display device according to claim 1, further comprising an area detection circuit, wherein the area detection circuit, in operation, determines a degradation state of each of the plurality of sub-pixels based on accumulated current data in each of the plurality of sub-pixels, and detects one or more areas having a degradation difference greater than or equal to a threshold level as the afterimage occurrence predicted area.

7. The display device according to claim 1, further comprising a control timing determining circuit, wherein the control timing determining circuit, in operation, determines the image quality control period as a period during which a display surface of the display panel is not exposed.

8. The display device according to claim 1, wherein the display device is a foldable display device, and the image quality control period is a period during which the foldable display device is folded and a display surface of the display panel is not exposed.

9. The display device according to claim 1, wherein the display device is a rollable display device, and the image quality control period is a period during which the rollable display device is rolled and the display surface of the display panel is not exposed.

10. A method comprising:

determining an image quality control period of a display panel of a display device;

detecting an afterimage occurrence predicted area of the display panel; and displaying a degradation uniformity restoration image in the afterimage occurrence predicted area during the image quality control period by driving the display panel, wherein the afterimage occurrence predicted area includes a first sub-pixel of a plurality of sub-pixels of the display panel, and a second sub-pixel of the plurality of sub-pixels, wherein before the image quality control period, the amount of accumulated current having flowed through the first sub-pixel is greater than the amount of accumulated current having flowed through the second sub-pixel, wherein during the image quality control period, the amount of current flowing through the second sub-pixel is greater than the amount of current flowing through the first sub-pixel, wherein the degradation uniformity restoration image includes a first portion in which a darkest image is present, and a second portion outside of the first portion, and the second portion becomes brighter as the second portion moves toward the first portion, and becomes darker as the second portion moves away from the first portion.

11. The method according to claim 10, wherein the afterimage occurrence predicted area is an area in which one or more object images of a logo, a subtitle, content information, and broadcast information are displayed during a normal display period before the image quality control period.

12. The display device according to claim 10, wherein the first sub-pixel and the second sub-pixel included in the afterimage occurrence predicted area have different degradation states, and the first sub-pixel is in a more degraded state than the second sub-pixel, and wherein when the driving of the display panel is performed, during the image quality control period the display device:

supplies a degradation acceleration data voltage to the second sub-pixel, the degradation acceleration data voltage configured to drive the second sub-pixel to emit light more brightly than the first sub-pixel, and supplies a degradation deceleration data voltage to the first sub-pixel, the degradation deceleration data voltage configured to drive the first sub-pixel to emit light more darkly than the second sub-pixel or to drive the first sub-pixel not to emit light.

13. The method according to claim 10, further comprising:

determining a degradation state of each of the plurality of sub-pixels by an area detection circuit based on accumulated current data in each of the plurality of sub-pixels, and determining the afterimage occurrence predicted area by the area detection circuit as one or more areas having a degradation difference greater than or equal to a threshold level.

14. The method according to claim 10, wherein when the determining of the image quality control period is performed, the display device determines the image quality control period as a period during which a display surface of the display panel is not exposed.

15. The method according to claim 10, wherein the display device is a foldable display device, and the image quality control period is a period during which the foldable display device is folded and a display surface of the display panel is not exposed.

16. The method according to claim 10, wherein the display device is a rollable display device, and the image quality control period is a period during which the rollable display device is rolled and a display surface of the display panel is not exposed.

17. A display device comprising: a display panel including a plurality of sub-pixels, each sub-pixel of the plurality of sub-pixels including a light emitting element and a driving transistor; and a display driving circuit, wherein the display driving circuit, in operation, drives the display panel, wherein the plurality of sub-pixels includes a first sub-pixel and a second sub-pixel having different degradation states, and the first sub-pixel is in a more degraded state than the second sub-pixel, and wherein during an image quality control period, the display driving circuit: supplies a degradation acceleration data voltage to the second sub-pixel that drives the second sub-pixel to emit light more brightly than the first sub-pixel, and supplies a degradation deceleration data voltage to the first sub-pixel that drives the first sub-pixel to emit light more darkly than the second sub-pixel or drives the first sub-pixel not to emit light, wherein during the image quality control period, a degradation uniformity restoration image is displayed in a detected afterimage occurrence predicted area on the display panel, wherein the first sub-pixel and the second sub-pixel are disposed in the afterimage occurrence predicted area, wherein the degradation uniformity restoration image includes a first portion in which a darkest image is present, and a second portion outside of the first portion, and wherein the second portion becomes brighter as the second portion moves toward the first portion, and becomes darker as the second portion moves away from the first portion.

18. The display device according to claim 17, wherein before the image quality control period, the first sub-pixel emits light having a first luminance value in response to a first data voltage, and the second sub-pixel emits light with a second luminance value different from the first luminance value in response to the first data voltage, and a difference between a reference luminance value and the first luminance value is greater than a difference between the reference luminance value and the second luminance value.

* * * * *